US006715167B2

(12) United States Patent
Wake

(10) Patent No.: US 6,715,167 B2
(45) Date of Patent: Apr. 6, 2004

(54) PATIENT LIFT AND TRANSFER APPARATUS

(76) Inventor: Sindy Lu Wake, 7113 Minoress Way, Sacramento, CA (US) 95842

( * ) Notice: Subject to any disclaimer, the term of this patent is extended or adjusted under 35 U.S.C. 154(b) by 0 days.

(21) Appl. No.: 10/349,783

(22) Filed: Jan. 24, 2003

(65) Prior Publication Data

US 2003/0140414 A1 Jul. 31, 2003

Related U.S. Application Data

(60) Provisional application No. 60/350,456, filed on Jan. 24, 2002.

(51) Int. Cl.[7] ..... A61G 7/10
(52) U.S. Cl. ..... 5/81.1 T; 5/89.1
(58) Field of Search ..... 5/81.1 T, 89.1, 5/81.1 R; 224/159, 158; 296/140

(56) References Cited

U.S. PATENT DOCUMENTS 869,325 A * 10/1907 Oehrmann ..... 294/140
1,876,832 A * 9/1932 Bancroft ..... 5/89.1
2,523,891 A * 9/1950 Wallatrom ..... 5/89.1
2,663,031 A * 12/1953 Kacthoff ..... 5/89.1
D366,550 S * 1/1996 Shapiro ..... D34/28
5,647,378 A * 7/1997 Farnum ..... 5/81.1 T
6,122,778 A * 9/2000 Cohen ..... 5/81.1 R
6,276,006 B1 * 8/2001 Hoit ..... 5/81.1 T

* cited by examiner

*Primary Examiner*—Alexander Grosz
(74) *Attorney, Agent, or Firm*—John P. Costello

(57) ABSTRACT

A two piece incorporated device designed to assist in the lifting and transfer of such person who is partially incapacitated by infirmity or disability from one sitting position in one location to another sitting position in another location. (ex: wheelchair to toilet, bed to chair, etc.) The device includes a torso belt with hold and support handles on back, secured by sewn on hook and loop style fastener; and a thigh support segment with handles sewn into either end, which supports the posterior and weight of said patient. The connection of these two pieces with quick-disconnect buckles provides a greater sense of balance for patient and attendant(s) and helps eliminate weight stress on the patient by virtue of proper weight distribution. The thigh support segment is also equipped with forward positioning straps (at either end), which facilitate a rocking forward by the attendant(s), bringing patient closer prior to lifting.

10 Claims, 3 Drawing Sheets

PATIENT LIFT AND TRANSFER APPARATUS

This application claims benefit of Provisional Application No. 60/350,456, filed Jan. 24, 2002.

BACKGROUND OF THE INVENTION

Previous efforts in this environment displays a rather profound lack of ingenuity in addressing this problem. Indeed there are many devices that assist in the lift and carry of such a patient, however such devices do not consider the physical weight stress upon the patient, nor do such devices consider the proper balance of patient weight which would ease the physical requirement and stress of the attendant(s). Moreover such devices do not address the emplacement or removal of such a device reference the comfort to the patient and the accommodation to the attendant(s).

In U.S. Pat. Nos. 4,782,539 and 5,515,549 the inventions are chair-like and have no means of securing the patient into the transfer device. U.S. Pat. No. 4,450,991 is not easily adaptable for transfer purposes, as the open torso strap does not allow for torso support contiguous to the thighs. U.S. Pat. No. D366,550 is completely inadequate to support the thighs during transfer. U.S. Pat. Nos. 4,944,057 and D366,550 are extremely difficult to get under the patient prior to the transfer; U.S. Pat. No. 4,944,057 is a bucket-style seat, which gives no torso (or trunk) support. The current invention goes beyond the method for transfer described in U.S. Pat. No. 5,297,834 with its ability to be used by one or more attendants and with its support of the torso.

BRIEF SUMMARY OF THE INVENTION

The present invention relates primarily to devices and or apparatus which assist in the lifting and transfer of those persons who are partially incapacitated by infirmity or disability from one sitting position, in one location, to a sitting position in another location, and from a sitting position to that of a standing position. The present invention overcomes all of the problems associated with the prior art.

One objective is to provide a more balanced weight distribution of said patient to ease in the lift and transfer of the same, as well as to better distribute weight stress on the patient.

Another objective of this invention is to locate the thigh support segment of the device in such a forward position to the posterior of the patient, that when combined with the quick disconnect buckles to the body segment, a greater ease of facilitation is achieved in placing the patient on a toilet, as well as the emplacement or removal of said device on or from the patient.

Yet another objective of this invention is the forward movement or positioning straps located on the forward section, either side of the thigh support segment. The purpose of these two straps is to, once harnessed in the device, move the patient forward in his current sitting position to one more accessible to the lift and transfer, thus providing greater balance for the attendant(s) and less stress for the patient.

A further objective of this invention is to provide a more convenient means by which to lift and transfer a patient. This invention, as it incorporates two separate segments, joined by two quick disconnect buckles, does not require undo movement or jostling of the patient for the harnessing of said patient. The forward position of the thigh support segment of this device to the posterior itself does not require that the patient be moved; therefore a more convenient method of lift and transfer is afforded the patient and the attendant(s).

Other objectives of the device will in part be obvious and will in part appear in drawing and or word content hereinafter.

Built upon the foregoing objectives, the invention embodies a two part segmented sling type device with a torso (waist) belt, both segments fabricated from a cloth material (such as nylon), both of rectangular shape, connected by straps with quick disconnect buckles. Each segment to be folded upon itself and stitched to accommodate such weight as may be anticipated by size of the patient, i.e., child, woman, man. The fabric handles (such as nylon strap), sewn into either side of the main thigh support segment, provide single or tandem lift and transfer capability. Combined with the sewn in cloth handles on the rear of the torso (waist) belt provides a far greater safety and comfort than is currently available.

The foregoing and additional features and advantages of this invention will be more discernible from the following detailed description shown in the accompanying drawings.

DETAILED DESCRIPTION OF THE INVENTION

Figure 1:
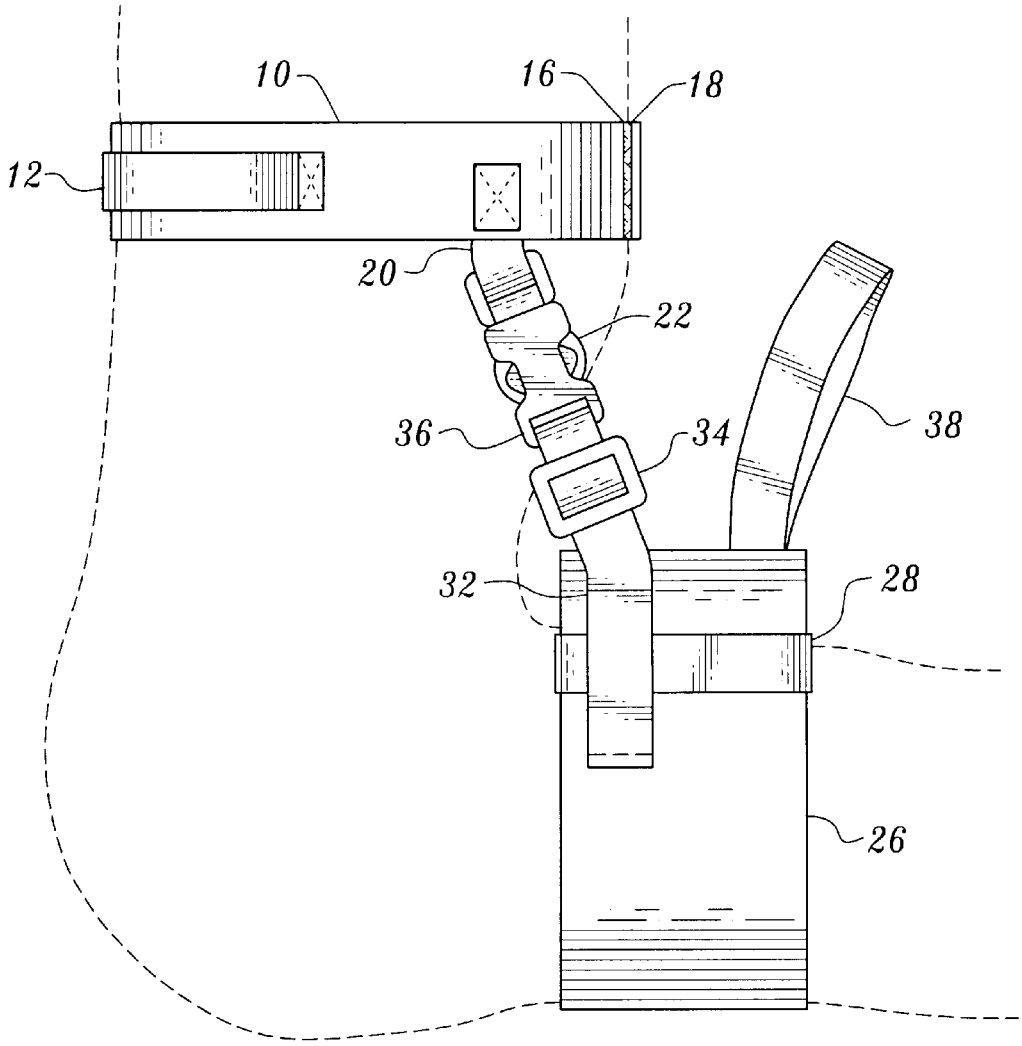
FIG. 1 is a side view perspective of patient seated within said invention.

Reference now the drawings, in FIG. 1 is shown a side perspective of the invention in which an outline of a patient is depicted. The embodied assumption is that the human outline depicted in FIG. 1 is, in some way, impaired and requires assistance. FIG. 1 demonstrates the harnessed position, to the patient, of the invention. The device is comprised of a rectangular main Thigh Support Segment of sturdy material (such as nylon) with the flexibility to contour to the shape of the thigh. Thigh Support Segment supports the patient's weight and is equipped with two sewn in lift and support handles 28 and 28' (not shown), as well as two forward positioning straps 38 and 38' (not shown), two connecting female buckle straps 32 and 32' (not shown), two strap adjustment assemblies 34 and 34' (not shown) and two female quick-disconnect buckle ends 36 and 36'.

Body segment 10 is a rectangular torso or waist segment of sturdy but flexible material (such as nylon strap). The Body Segment 10 is equipped with two connecting male buckle straps 20 and 20' (not shown) attached to the one end of t he two male quick-disconnect buckles 22 and 22' (not shown), hook side hook and loop type fastener 16, loop side hook and loop type fastener 18 for adaptability to different patient sizes, one rear, sewn in fabric handle (such as nylon strap) 12, which is sewn onto segment 10 in the center and on each end to be utilized in the lift and carry or pull forward or positioning of the patient by one or more attendant(s).

Body Segment 10 when connected to the Thigh Support Segment 26, by joining the male and female quick disconnect assemblies 22 and 36 provides both upper body and thigh support for the patient and lift and carry balance for the attendant(s) when lifting or transfering the patient.

Figure 2:
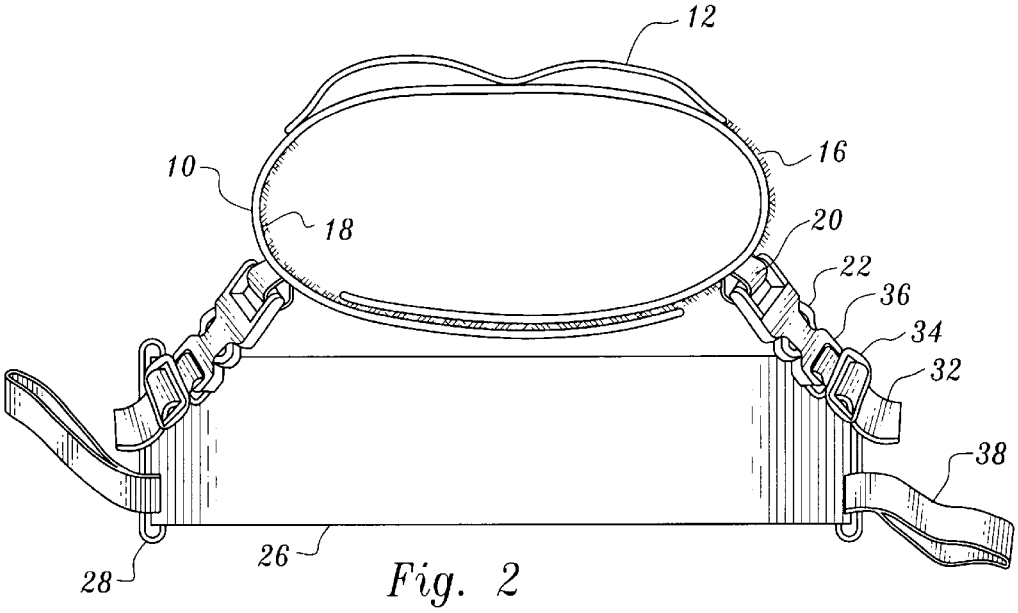
FIG. 2 is a top view perspective without patient outline.

In FIG. 2 is shown the top perspective of the invention. FIG. 2 shows Body Segment 10 with its fabric (nylon strap) handle 12 sewn to 10 in its center and on each of its ends, hook 16 and loop 18 fasteners are shown to be adjustable for accommodation to different patient sizes, the two male buckle connecting straps 20 and 20' and two male quick-disconnect buckles 22 and 22'. The patient would sit atop Thigh Support Segment 26 when harnessed in the invention. Thigh Support Segment 26 is shown with two lift and support handles 28 and 28' and two forward positioning straps 38 and 38' sewn into either end, along with the female quick-disconnect buckle 36 and 36' which are attached by the two female buckle connecting straps 32 and 32' made adjustable by the two strap adjustment assemblies 34 and 34' to accommodate patients of different heights. In use, the Thigh Support Segment 26 would be passed under the legs of the patient prior to attaching buckles 36 and 36' to body segment buckles 22 and 22'.

Figure 3:
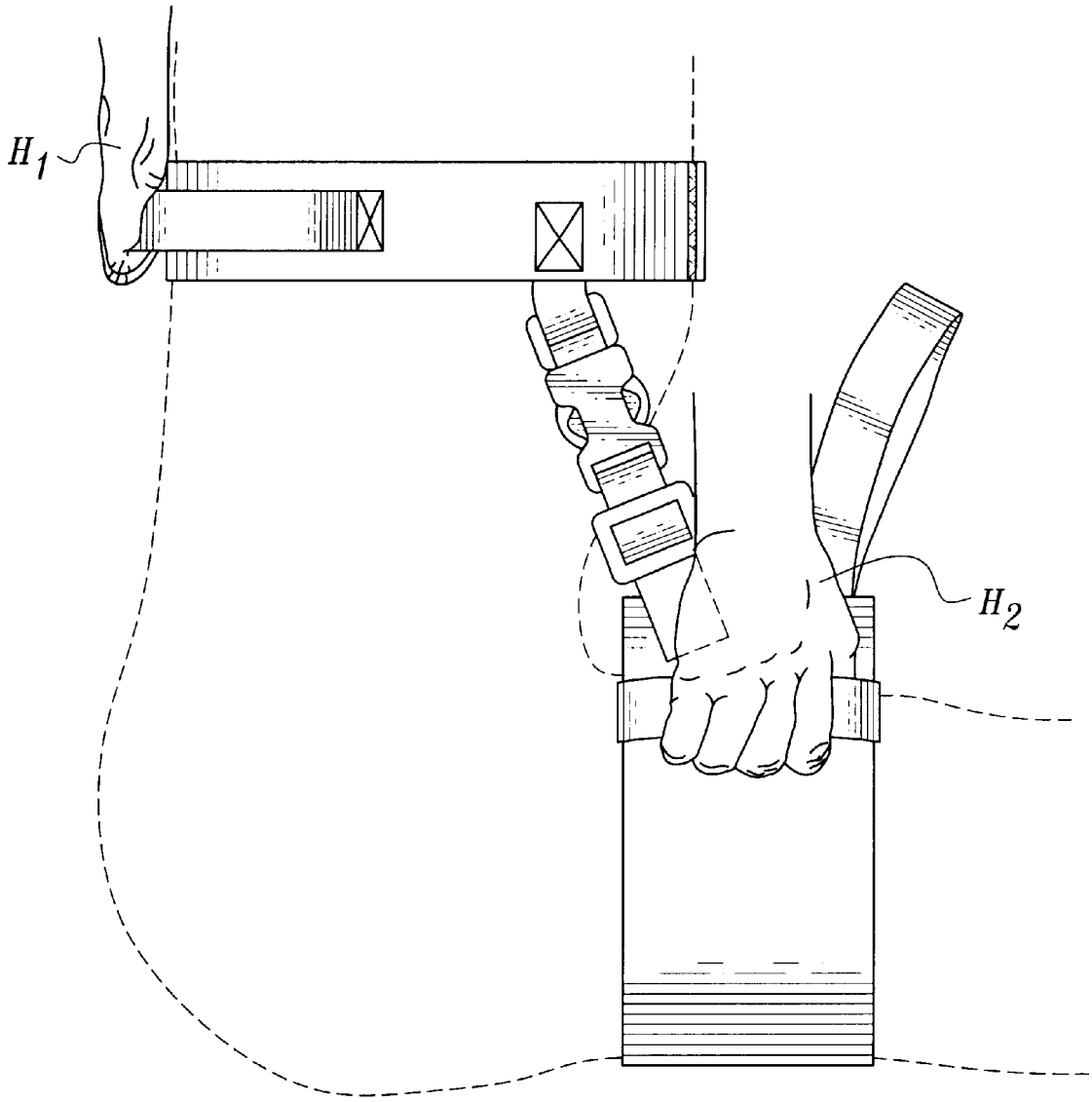
FIG. 3 is a side view perspective showing hand placement for patient transfer by more than one attendant.

In FIG. 3 is shown a side perspective of said invention demonstrating attendants hands H1 (other attendant is presumed on opposite side) inserted into the fabric handles 12 and 12' (not shown) on the Body Segment 10 for the purpose of lifting the patient and also shows the attendants hands H2 (other attendant is presumed on opposite side) placed in the carry position of lift and support handles 28 and 28' (not shown) at either end of Thigh Support Segment 26 and shows attendants pulling patient forward and up for the purpose of transfer. Being joined together at female buckle assembly 22 and 22' (not shown) and male buckle assembly 36 and 36' (not shown) demonstrates how patient is maintained in a sitting position allowing the attendant to easily transfer the patient.

What is claimed is:

1. A patient lift and transfer device, comprising:

a flexible, generally rectangular, adjustable body segment adapted to removably surround a portion of the torso or waist of patients of different sizes, the body segment further comprising handle means;

a flexible, generally rectangular thigh supporting segment adapted to support the thighs of a seated user, the thigh supporting segment comprising handle means and positioning strap means; and connecting means adapted to separably connect the body segment to the thigh support, the connecting means having an adjustable length.

2. The patient lift and transfer device of claim 1, the body segment is adjustable with hook and loop fasteners.

3. The patient lift and transfer device of claim 2, wherein the connecting means comprises a strap, a strap adjustment assembly and a buckle.

4. A patient lift and transfer device, comprising:

a flexible body segment, the body segment being circumferentially adjustable for snugly fitting around the torso or waist of wearers of different sizes;

a thigh supporting segment for supporting the thighs of a wearer; and connecting means for separably connecting the body segment to the thigh supporting segment.

5. The patient lift and transfer device of claim 4, wherein the body segment further comprises handle means.

6. The patient lift and transfer device of claim 4, wherein the thigh supporting segment further comprises handle means and positioning strap means.

7. The patient lift and transfer device of claim 4, wherein the body segment is adjustable with hook and loop fasteners.

8. The lift and transfer device of claim 4, wherein the connecting means further comprises a strap, a strap adjustment assembly and a buckle.

9. A patient lift and transfer device, comprising:

a body segment, the body segment adapted to removably surround a portion of the torso or waist of wearers of different sizes;

a thigh supporting segment for supporting the thighs of a wearer; and connecting means for separably connecting the body segment to the thigh supporting segment.

10. The patient lift and transfer device of claim 9, wherein the connecting means further comprises an adjustable strap assembly to allow the vertical adjustment of the body segment in relation to the thigh supporting segment.

* * * * *